US010450819B2

(12) United States Patent
Zhang et al.

(10) Patent No.: US 10,450,819 B2
(45) Date of Patent: Oct. 22, 2019

(54) TOOL ASSEMBLY WITH A FLUIDIC AGITATOR

(71) Applicants: CNPC USA Corp., Houston, TX (US); Beijing Huamei, Inc., Beijing (CN)

(72) Inventors: Ming Zhang, Spring, TX (US); Chris Cheng, Houston, TX (US); Dengxiang Bai, Beijing (CN); Xiongwen Yang, Beijing (CN); Kuangsheng Zhang, Shanxi (CN); Yuming Wang, Shanxi (CN); Peiyuan Hu, Shanxi (CN)

(73) Assignees: CNPC USA Corp., Houston, TX (US); Beijing Huamei, Inc., Beijing (CN)

( * ) Notice: Subject to any disclaimer, the term of this patent is extended or adjusted under 35 U.S.C. 154(b) by 31 days.

(21) Appl. No.: 15/820,273

(22) Filed: Nov. 21, 2017

(65) Prior Publication Data

US 2019/0153798 A1 May 23, 2019

(51) Int. Cl.
*E21B 28/00* (2006.01)

(52) U.S. Cl.
CPC ..... *E21B 28/00* (2013.01)

(58) Field of Classification Search
CPC ..... E21B 28/00
USPC ..... 166/380
See application file for complete search history.

(56) References Cited

U.S. PATENT DOCUMENTS

| | | | | |
|---|---|---|---|---|
| 8,931,566 | B2 | 1/2015 | Dykstra et al. | |
| 8,944,160 | B2 | 2/2015 | Surjaatmadja et al. | |
| 9,194,208 | B2 | 11/2015 | Schultz et al. | |
| 9,212,522 | B2 | 12/2015 | Schultz et al. | |
| 9,260,952 | B2 | 2/2016 | Fripp et al. | |
| 9,316,065 | B1 | 4/2016 | Schultz et al. | |
| 9,328,587 | B2 | 5/2016 | Surjaatmadja et al. | |
| 9,546,536 | B2 | 1/2017 | Schultz et al. | |
| 2012/0292116 | A1* | 11/2012 | Schultz | E21B 7/24 175/162 |
| 2013/0075107 | A1* | 3/2013 | Dykstra | E21B 34/08 166/373 |

* cited by examiner

*Primary Examiner* — Taras P Bemko
(74) *Attorney, Agent, or Firm* — Craft Chu PLLC; Andrew W. Chu

(57) ABSTRACT

The tool assembly vibrates a casing string or drill string in a wellbore. The tool assembly includes a housing, an insert mounted in the housing as a fluidic agitator, and a cover fitted over the insert. The insert includes an inlet chamber, a vortex chamber, and a feedback chamber, and the fluid flow through the insert has a pressure profile with a plurality of levels determined by the feedback chamber. The strength and frequency of the pressure profile can be regulated by the feedback chamber according to position, size and asymmetry of the transition channels connected to the feedback chamber. The high strength and low frequency pressure pulses can be achieved in the limited space of the housing for placement of the inlet and outlet.

16 Claims, 4 Drawing Sheets

TOOL ASSEMBLY WITH A FLUIDIC AGITATOR

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to downhole tools in the oil and gas industry. More particularly, the present invention relates to a tool assembly to generate vibration on a casing string or drill string. The present invention also relates to controlling fluid flow oscillations.

2. Description of Related Art Including Information Disclosed Under 37 CFR 1.97 and 37 CFR 1.98

Fluidic components, such as vortex chambers, fluidic switches and feedback loops, are already known to set the flow path through a variable resistance device of a downhole tool. A fluidic agitator generates vibration along a drill string or casing string, so that the respective string can pass bends and angles in the wellbore. The string can pass through tight turns instead of getting stuck on the edge of a rock formation. A fluidic oscillator can pulse the delivery of fluid so that control screens can be cleaned, scale can be removed from casing, and other chemical treatments can be effectively delivered to the downhole location by a pressure pulse. There has always been a need to control fluid flow through the wellbore.

U.S. Pat. No. 8,931,566, issued on 13 Jan. 2015 to Dykstra et al. describes a fluid agitator with curved fluid chamber having a fluid diode as a switch between two ports for generating vibration from the tubular housing of a downhole tool.

U.S. Pat. No. 8,944,160, issued on 3 Feb. 2015 to Surjaatmadja et al. discloses a fluidic agitator with pulsed fluid discharge for the vibration of the tubular string through the wellbore. The flow control relates to discharging fluid in a selected direction for the vibration of the tubular string along the wellbore. U.S. Pat. No. 9,328,587, issued on 3 May 2016 to Surjaatmadja et al. addresses the physical fluid chamber component of the fluidic agitator.

U.S. Pat. No. 9,260,952, issued on 16 Feb. 2016 to Fripp et al. discloses controlling fluid flow with a switch in a fluidic oscillator also. The device delivers fluids downhole as selected for various characteristics and conditions downhole. The fluid chamber relies on physical shapes and structures to split, switch, and shape fluid flow so that the output can be regulated autonomously.

U.S. Pat. No. 9,546,536, issued on 17 Jan. 2017 to Schultz et al., U.S. Pat. No. 9,316,065, issued on 19 Apr. 2016 to Schultz et al., and U.S. Pat. No. 9,212,522, issued on 15 Dec. 2015 to Schultz et al., all show the wide range of shapes and pathways for a fluid chamber. The different vortex chambers and numbers of vortex chambers, feedback loops and flow paths of feedback loops are shown. The tangential and radial connections, and the placement of outlets can also set the sequence of the flow path through the components to affect fluid flow.

It is an object of the present invention to control fluid flow in a downhole tool.

It is an object of the present invention to provide a tool assembly for vibrations in a wellbore.

It is an object of the present invention to provide a fluidic agitator for vibrating a tubular string through a wellbore.

It is an object of the present invention to provide a fluidic oscillator for regulating fluid flow and fluid pressure in a wellbore.

It is another object of the present invention to provide a tool assembly for vibrations with an insert having a feedback chamber.

It is another object of the present invention to provide a tool assembly for vibrations with an asymmetric flow path.

It is still another object of the present invention to provide a tool assembly for vibrations with asymmetric flow path through an input chamber, a switch, a vortex chamber, and a feedback chamber.

It is still another object of the present invention to provide a tool assembly for vibrations with asymmetric flow path between a vortex chamber and a feedback chamber of an insert of the tool assembly.

It is still another object of the present invention to provide a tool assembly for vibrations with asymmetric flow path through an input chamber, a switch, a vortex chamber, and a feedback chamber.

It is yet another object of the present invention to provide a tool assembly for vibrations with one channel between a vortex chamber and a feedback chamber larger than another channel between the vortex chamber and the feedback chamber.

These and other objectives and advantages of the present invention will become apparent from a reading of the attached specifications and appended claims.

BRIEF SUMMARY OF THE INVENTION

The tool assembly of the present invention is a fluidic agitator used in a downhole tool to vibrate the drill string so that the drill string can pass by curves and bends in the borehole. The vibrations reduce friction as the drill string rubs against the bend in a rock formation. The strength and frequency of the vibrations affect the efficiency and effectiveness of the fluidic agitator. The tool assembly has a pressure profile with multiple levels, such as a lower level, a middle level, and a higher level. Thus, the range of strength of the pressure pulses is greater than conventional fluidic agitators. Furthermore, the range of frequency of the higher level allows for lower frequency vibrations than conventional fluidic agitators. In the present invention, the range of frequency is achieved without increasing the distance from the inlet chamber and vortex chamber. The tool assembly includes a housing having an inlet and an outlet, a insert mounted in the housing, and a cover fitted over the insert in the housing. The cover seals the insert within the housing for installation in a casing string or drill string. The tool assembly may also be used as a fluidic oscillator for more general fluid flow control for delivery of fluids downhole under the resulting pressure profile of the insert.

Embodiments of the tool assembly include an insert comprising an inlet chamber, a vortex chamber, and a feedback chamber. The inlet chamber is in fluid connection with the inlet of the housing, and the vortex chamber has an output in fluid connection to the outlet of the housing. The fluid flow through the inlet at the input chamber, vortex chamber, and feedback chamber has a pressure profile with a plurality of levels, corresponding to the number of feedback chamber. Additionally, the pressure profile has a frequency determined by the feedback chamber when the input chamber maintains a constant position and fluid connection to the vortex chamber. In some embodiments, the input chamber, vortex chamber and feedback chamber are in an asymmetric flow path. The insert includes a first input channel connecting the inlet chamber to one side of the vortex chamber, and a second input channel connecting the inlet chamber to an opposite side of the vortex chamber. There is a switch means in the input chamber based on the Coanda effect for the flow path alternating between the first input channel and the second input channel.

Some embodiments include a first transition channel connecting the vortex chamber to one side of the feedback chamber, and a second transition channel connecting the vortex chamber to an opposite side of the feedback chamber. The second transition channel is larger than the first transition channel so that the asymmetry is in this position in the flow path. This asymmetric flow path comprises a first fluid flow from the input chamber to the first input channel and to the vortex chamber is in a first direction around the vortex chamber, and a second fluid flow from the input chamber to the second input channel and to the vortex chamber is in a second direction around the vortex chamber. The second direction is opposite the first direction.

The first fluid flow can continue from the vortex chamber to the feedback chamber by the first transition channel and is in a first circulation direction around the feedback chamber. The second fluid flow can continue from the vortex chamber to the feedback chamber by the second transition channel and is in a second circulation direction around the feedback chamber. The second circulation direction is opposite the first circulation direction. The embodiments of the tool assembly include both the second transition channel having a larger width dimension than the first transitional channel and the second transition channel having a smaller width dimension than the first transitional channel. The transition channels are different for the asymmetry in this embodiment.

There can also be a first flowback channel extending from the feedback chamber to the input chamber, and a second flowback channel extending from the feedback chamber to the input chamber. These flowback or feedback channels return fluid back to the input chamber.

Embodiments of the present invention include the method of vibrating a casing string or drill string in a wellbore. The method includes assembling the tool with the insert having the feedback chamber and asymmetric flow path, installing the tool on the casing string or drill string, flowing a fluid through the insert with a pressure profile with multiple levels, and generating vibrations in the tool according to the pressure profile and feedback chamber. The method includes the step of flowing the fluid through the insert with alternating the flow path between the first input channel and the second input channel for the first fluid flow path and the second fluid flow path of the asymmetric flow path.

The step of flowing the fluid through the insert includes flowing the fluid between the vortex chamber and the feedback chamber, according to the step of alternating between the first fluid flow path and the second fluid flow path. In embodiments of the tool assembly with flowback channels or feedback channels, the method can further include the step of flowing the fluid between the feedback chamber and the input chamber.

DETAILED DESCRIPTION OF THE INVENTION

Fluid control in a wellbore is important for more than one reason. A fluidic agitator can be used in a downhole tool to vibrate a tubular string, such as a drill string or casing string, so that the tubular string can pass by curves and bends in the borehole. A fluidic oscillator can be used to pulse fluid treatment chemicals to downhole locations in the wellbore. A pressure pulse of a fluid treatment can be used to clean components in the remote downhole locations. The strength and frequency of the vibrations or pressure pulses affect the efficiency and effectiveness of the fluid control tool assembly. There is limited space in a downhole tool, and there is a need for the control without enlarging the agitator.

Figure 1:
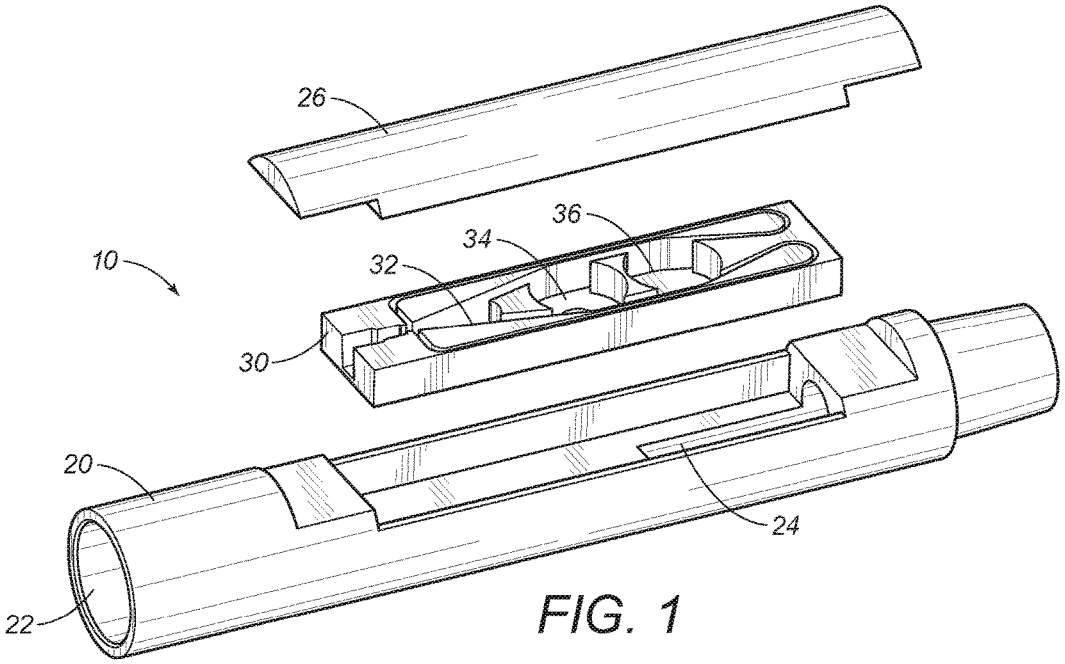
FIG. 1 is an exploded perspective view of the tool assembly, according to embodiments of the present invention.

Referring to FIGS. 1-5, the tool assembly 10 is a fluid control downhole tool that can be adapted for use as a fluidic agitator or a fluidic oscillator. FIG. 1 shows the tool assembly 10 for installation in a tubular string, such as a drill string or a casing string to be deployed in a wellbore. The tool assembly 10 includes a housing 20 having an inlet 22 and an outlet 24, an insert 30 mounted in the housing 20, and a cover 26 fitted over the insert 30 in the housing 20. The cover 26 seals the insert 30 within the housing 20 for installation in a casing string or drill string. The insert 30 comprises an inlet chamber 32, a vortex chamber 34, and a feedback chamber 36. The housing 20 and cover 26 can be adapted to be incorporated in a tubular string with fluid flow through the tool assembly 10 in line with the tubular string, which may extend from a surface location to a downhole location in a wellbore.

Figure 5:
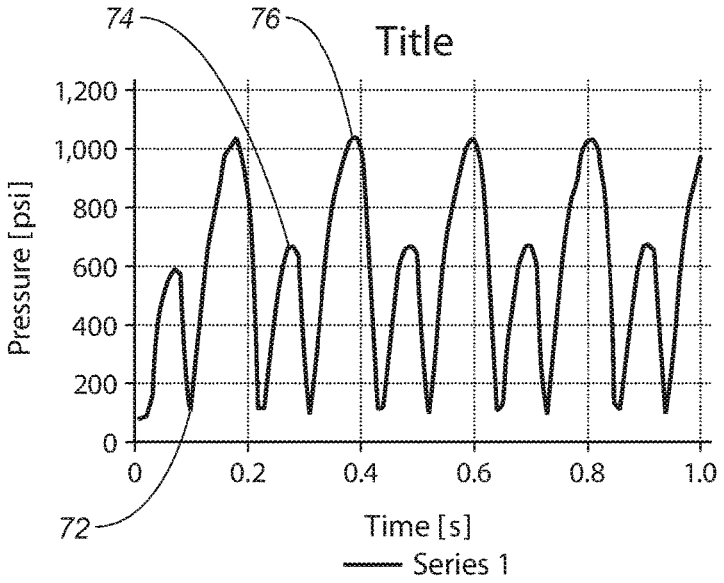
FIG. 5 is a graph illustration of the pressure profile of a fluid flow through the insert of the tool assembly, according to embodiments of the present invention.

As shown in FIG. 5, the fluid flow of the tool assembly 10 has a pressure profile with a plurality of levels. In this embodiment, there are three levels: a lower level 72, a middle level 74, and a higher level 76. The strength of the pressure pulse has a greater range than conventional fluidic oscillators and fluidic agitators. The build up and peak of the higher level 76 can be achieved with only the insert 30 of the present invention. The frequency between the higher level 76 pressure pulses has a greater range than conventional fluidic oscillators and fluidic agitators. The time between peaks of the higher level can be achieved at lower frequencies with only the insert 30 of the present invention. The tool assembly 10 provides for pressure pulses and vibrations downhole in the more desirable lower frequencies and stronger pulses for fluidic agitators.

Additionally, the pressure profile has a frequency determined by the feedback chamber 36 of the insert 30. With the feedback chamber 36 in fluid connection between the vortex chamber 34 and the input chamber 32, the input chamber 32 can be placed in a constant position and in fluid connection to the vortex chamber 34. Thus, the inlet 22 and the outlet 24 are matched with the input chamber 32 and vortex chamber 34. In some embodiments, the input chamber 32 and the vortex chamber 34 can be placed close together, just as the inlet 22 would be placed near the outlet 24. The feedback chamber 36 in the insert is positioned to regulate frequency as a buffer to delay feedback flow. The sizes of the inlet 22 and outlet 24 are no longer expanded or narrowed to control frequency, and the distance between the inlet 22 and input chamber 32 to the outlet 24 and the vortex chamber 34 are no longer extended or retracted to control frequency. The structure, size and arrangement of the insert 30 achieve the pressure profile with a plurality of levels with ranges of strength and frequency required for downhole activity.

Figure 2:
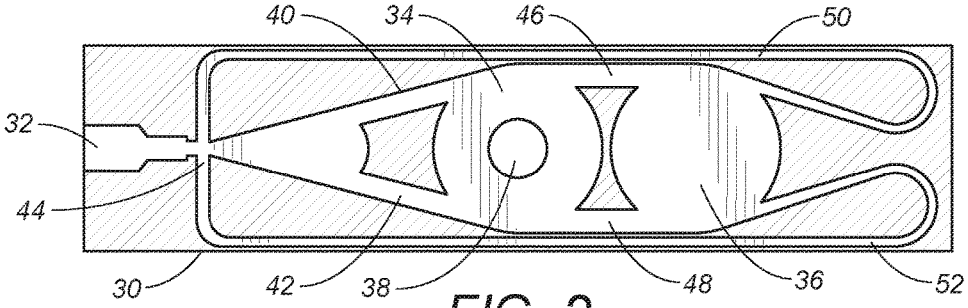
FIG. 2 is a longitudinal cross sectional view of an embodiment of an insert of the tool assembly according to embodiments of the present invention.
Figure 3:
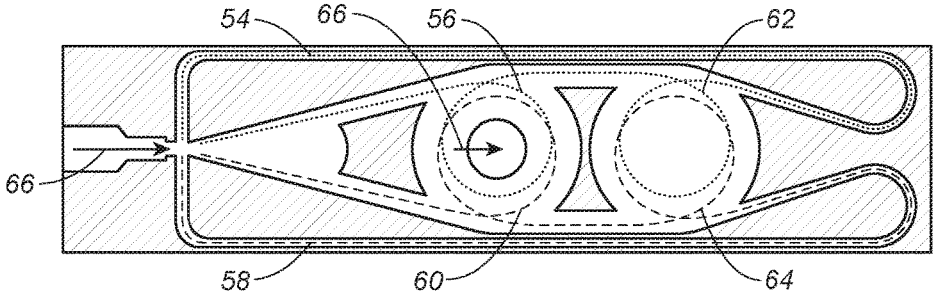
FIG. 3 is a longitudinal cross sectional view of an embodiment of an insert of the tool assembly according to embodiments of the present invention, showing flow paths.
Figure 4:
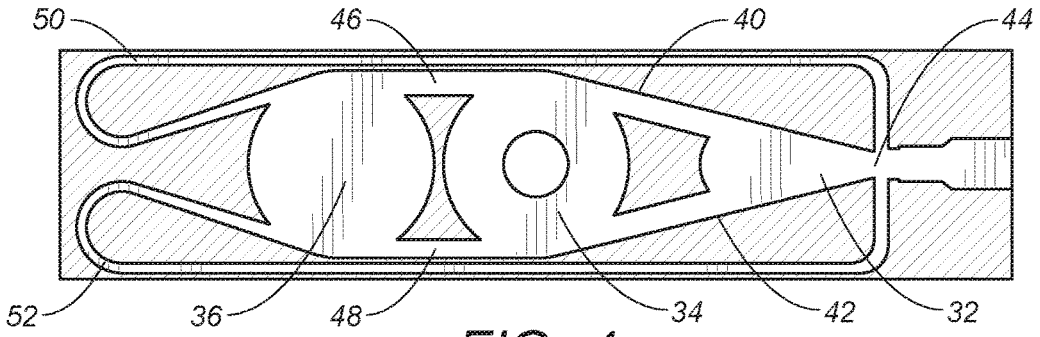
FIG. 4 is a schematic view of an embodiment of an asymmetric flow path through the insert of the tool assembly according to embodiments of the present invention.

Embodiments of the tool assembly 10 include an insert 30 comprising an inlet chamber 32, a vortex chamber 34, and a feedback chamber 36 in fluid connection between the vortex chamber 34 and the inlet chamber 32. The inlet chamber 32 is fluid connection with the vortex chamber 34 directly and through the feedback chamber 36, as shown in FIGS. 2-4. The inlet chamber 32 is in fluid connection with the inlet 22 of the housing 20, and the vortex chamber 34 has an output 38 in fluid connection to the outlet 24 of the housing 20. The fluid flow through the insert starts at the input 22 and moves through the input chamber 32, the vortex chamber 34, and the feedback chamber 36 with the exit through the output 38 in the vortex chamber 34. FIGS. 2-4 shows the insert 30 comprising a first input channel 40 connecting the inlet chamber 32 to one side of the vortex chamber 34, and a second input channel 42 connecting the inlet chamber 32 to an opposite side of the vortex chamber 34. The first and second input channels 40, 42 are mirror images of each other, being symmetrical in position along the longitudinal axis orientation or center line of the insert 30. FIGS. 2-4 show the first and second input channels 40, 42 each being tangent to the vortex chamber 34 in a symmetrical arrangement across a center line of the insert 30.

FIGS. 2-4 show the insert 30 having a switch means 44 in the input chamber 32. In some embodiments, the switch means 44 is based on the Coanda effect for a flow path alternating between the first input channel 40 and the second input channel 42. The switch means 44 can be other known fluidic switches, in addition to the Coanda-based embodiment of FIGS. 2-4.

The insert 30 also includes a first transition channel 46 connecting the vortex chamber 34 to one side of the feedback chamber 36, and a second transition channel 48 connecting the vortex chamber 34 to an opposite side of the feedback chamber 36. The feedback chamber 36 is in fluid connection to the vortex chamber 34. The first and second transition channels 46, 48 are mirror images of each other, being symmetrical in position along the longitudinal axis orientation or center line of the insert 30. FIGS. 2-4 show the first and second transition channels 46, 48 each being tangent to the vortex chamber 34 and the feedback chamber 36 in a symmetrical arrangement across a center line of the insert 30.

FIGS. 2-4 also show the insert 30 having a first flowback channel 50 extending from the feedback chamber 36 to the inlet chamber 32, and a second flowback channel 52 extending from the feedback chamber 36 to the inlet chamber 32. These flowback or feedback channels 50, 52 return fluid back to the input chamber 32. The first and second flowback channels 50, 52 are mirror images of each other, being symmetrical in position along the longitudinal axis orientation or center line of the insert 30, similar to the first and second input channels 40, 42. The embodiments show the flowback channels 50, 52 in tangent connections to the feedback chamber 36 in the same symmetric arrangement across the center line of the insert. The flowback channels 50, 52 are on different tangent connections than the transition channels 46, 48, and the flowback channels 50, 52 extend beyond the feedback chamber 36 before looping back past the feedback chamber 36, the vortex chamber 34, and then back to the inlet chamber 32.

Embodiments of the present invention include the inlet chamber 32, the vortex chamber 34, and the feedback chamber 36 in an asymmetric flow path 66. FIG. 4 shows the second transition channel 48 being larger than the first transition channel 46 so that the symmetry of the symmetrical arrangement is limited to the position of the tangent connections to the vortex chamber 34 and the feedback chamber 36. The embodiment of FIG. 4 shows the asymmetry of the asymmetric flow path 66 in this portion in the flow path. The first transition channel 46 has a width of about 6.0 mm, and the second transition channel 48 has a width of about 8.25 mm in this embodiment. Both transition channels 46, 48 remain in a symmetrical position on the vortex chamber 34 and the feedback chamber 36, but the transition channels 46, 48 are not identical. In alternative embodiments, the second transition channel 48 can be smaller in width than the first transition channel 46. The transition channels 46, 48 must be different, and the difference in width is one embodiment, while the positions relative to the vortex chamber 34 and the feedback chamber 36 remain in a symmetrical arrangement relative to the center line of the insert 30. Other dimensions, such as height or diameter may also be different between the transition channels 46, 48.

FIG. 4 shows the asymmetric flow path 66 being comprised of a first fluid flow path 54 from the inlet chamber 32 to the first input channel 40 and to the vortex chamber 34 in a first direction 56 around the vortex chamber 34, and a second fluid flow path 58 from the inlet chamber 32 to the second input channel 42 and to the vortex chamber 34 in a second direction 60 around the vortex chamber 34. The second direction 60 is opposite the first direction 56. The first input channel 40 and the second input channel 42 are both tangent to the vortex chamber 34 on opposing sides of the vortex chamber 34, being symmetrical across the center line of the insert 30.

The first fluid flow path 54 continues from the vortex chamber 34 to the feedback chamber 36 by the first transition channel 46 and is in a first circulation direction 62 around the feedback chamber 36. The second fluid flow path 58 continues from the vortex chamber 34 to the feedback chamber 36 by the second transition channel 48 and is in a second circulation direction 64 around the feedback chamber 36. The second circulation direction 64 is opposite the first circulation direction 62. In FIGS. 2-4, the first transition channel 46 is tangent to the vortex chamber 34 and the feedback chamber 36, while the second transition channel 48 is tangent to the vortex chamber 34 and the feedback chamber 36, in the same symmetrical arrangement relative to the center line of the insert 30. The dimensions of the transition channels 46, 48 are different, but the positions of connections relative to the vortex chamber 34 and the feedback chamber 36 are the same.

Embodiments of the present invention include the method for fluid control in a wellbore, which can be used for vibrating a casing string or drill string in the wellbore. The method includes assembling the tool 10 with the insert 30 having the feedback chamber 36 between the vortex chamber 34 and the input chamber 32 with the input chamber 32 in fluid connection with the vortex chamber 34 directly and through the feedback chamber 36, installing the tool 10 on a tubular string, such as a casing string or drill string, flowing a fluid through the insert 30 with a pressure profile with a plurality of levels, such as lower 72, middle 74 and higher 76 levels, and generating vibrations in the tool 10 according to the pressure profile. The feedback chamber 36 is a generally round cavity in the insert 30 without an output. Fluid can flow around in the feedback chamber 36, similar to a vortex chamber, except that there is no output for the fluid to leave the feedback chamber in the center of the feedback chamber. In some embodiments, the feedback chamber 36 is a circulation chamber positioned on the feedback side of the vortex chamber 34. The placement of the feedback chamber 36 creates a buffer to delay feedback flow to the input chamber. Previously, the feedback channels were lengthened or double backed to the input chamber, but there was no flow or circulation arrangement of the feedback chamber 36. The fluid must exit through the transition channel or flowback channel, which are tangent to the feedback chamber in FIGS. 2-4. In series with a vortex chamber, the feedback chamber 36 of the present invention is in fluid connection through transition channels 46, 48.

Figure 6A:
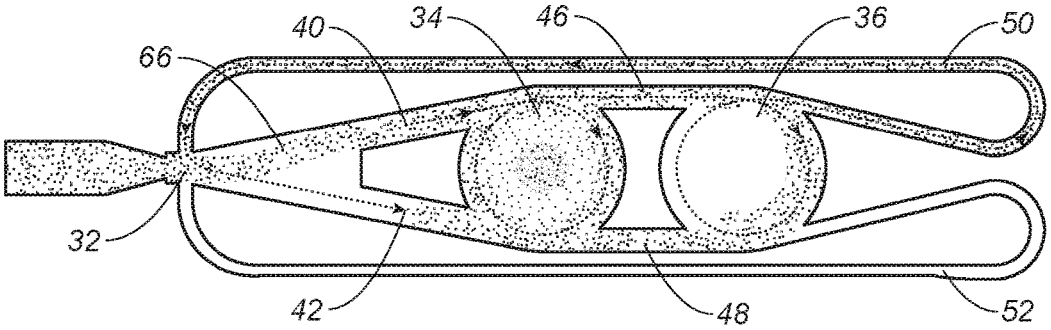
FIGS. 6*a-f* are cross sectional views of the embodiment of the method of the present invention, showing the flow path switching from the second input channel to the first channel.
Figure 6B:
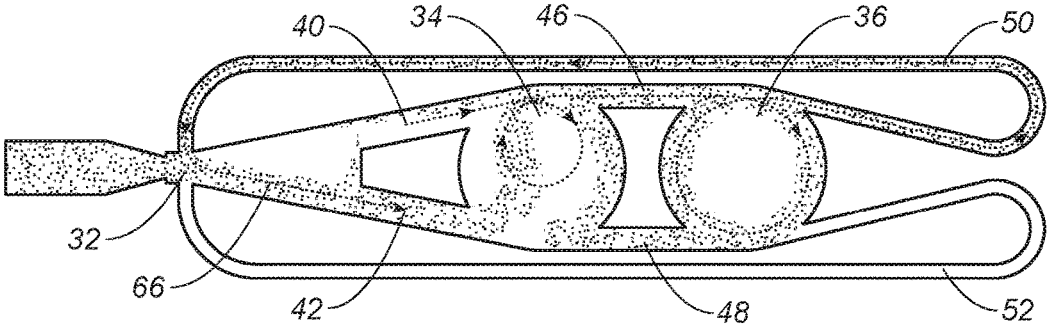
Figure 6C:
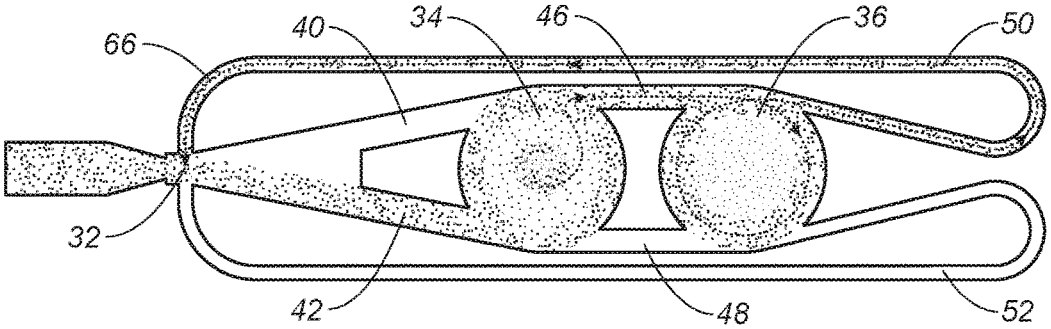

FIGS. 6*a*-6*f* show the progression of the step of flowing a fluid though the insert 30. FIG. 6*a* shows the flow path 66 with clockwise direction in both the vortex chamber 34 and the feedback chamber 36, wherein the flow path 66 includes fluid through the first feedback channel 50. The fluid through the first feedback channel 50 pushes the flow path 66 from the first input channel 40 to the second input channel 42. FIG. 6*b* shows the beginning of the switched flow path 66 to the second input channel 42. The clockwise flow in the vortex chamber 34 decays and the back pressure drops to near zero with the feedback chamber 36 still having a clockwise direction and the flow through the first feedback channel 50. FIG. 6*c* shows the vortex chamber 34 starts a counterclockwise direction against the feedback chamber 36 in a clockwise direction with flow from the first transition channel 46. The fluid flow from the first feedback channel 50 still provides the back pressure at the input chamber 32.

Figure 6D:
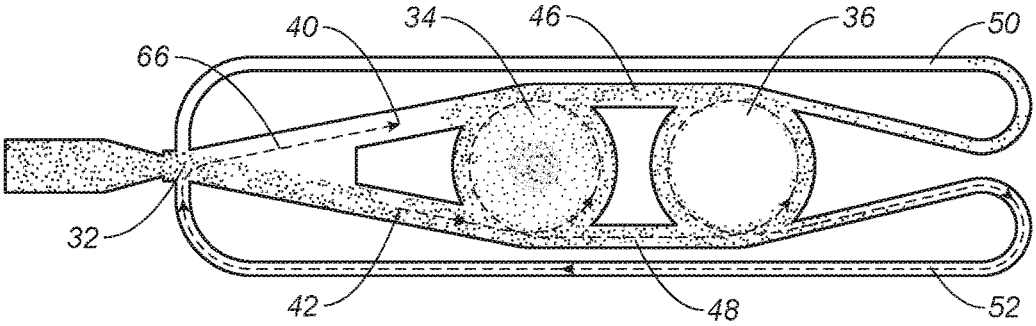
Figure 6E:
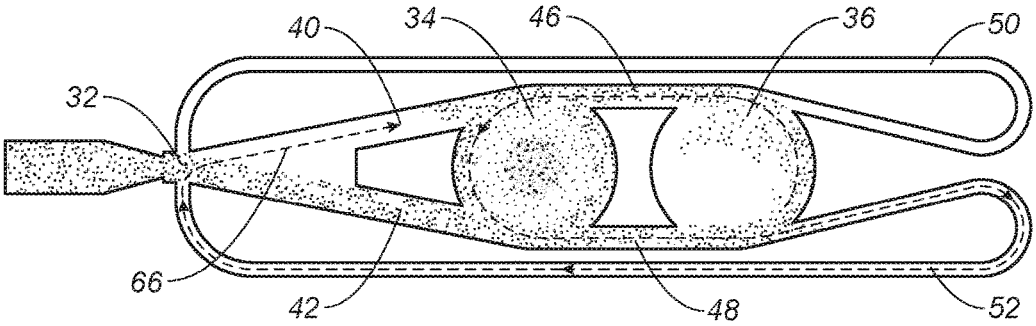
Figure 6F:
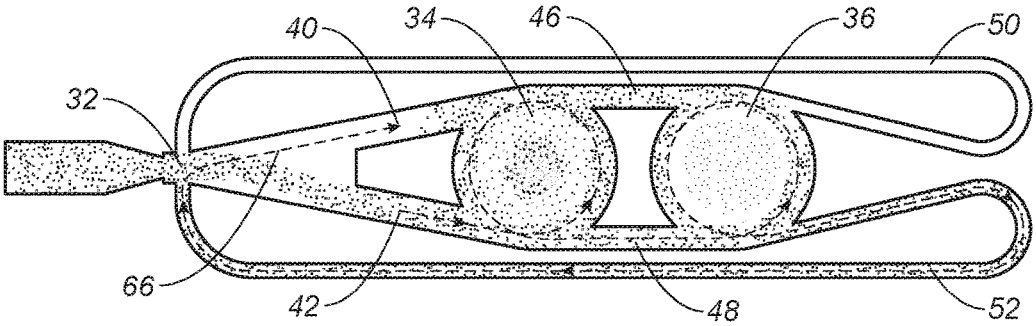

FIG. 6*d* shows a change with the flow path 66 in an established counterclockwise direction in the vortex chamber 34 and fluid flow through the second transition channel 48. This flow path 66 can correspond to a higher pressure level 76 in the pressure profile, which drops when the flow path 66 changes form the first transition channel 46 to the second transition channel 48. The clockwise direction in the feedback chamber 36 decays, so that the flow path 66 now includes the second feedback channel 52, instead of the first feedback channel 50. FIG. 6*e* shows the feedback chamber 36 having a counterclockwise direction with the flow path 66 through the second transition channel 48 and the second feedback channel 52, which returns the insert 30 to FIG. 6*f*. FIG. 6*f* is the opposite of FIG. 6*a* with the flow path 66 moving from the second input channel 42 back to the first input channel 40. The back pressure from the second feedback channel 52 finally builds to move the flow path 66 back to the first input channel 40, which results in a lower pressure level, such as the lower pressure level 72 or the middle pressure level 74. The tool assembly 10 includes the feedback chamber 36 in a relationship to the vortex chamber 34 as a buffer to delay feedback flow. As a result, the difference in the first and second transition channels 46, 48 and the feedback chamber 36 controls the strength and frequency of the pressure profile. There is a plurality of levels at variable frequency without changing the position of the inlet 22 and outlet 24. The insert 30 can have a different size feedback chamber 36 or different first and second transition channels 46, 48 without modifications to the housing 20. Within a limited space and without machining different inlets and outlets, the tool assembly 10 controls the vibrations with greater strength and range of frequencies.

When the insert 30 is comprised of a switch 44, the first input channel 40 and the second input channel 42 in fluid connection between the inlet chamber 32 and the vortex chamber 34, the step of flowing the fluid includes alternating the flow between the first input channel 40 and the second input channel 42 for the first fluid flow path 54 and the second fluid flow path 58 of the asymmetric flow path 66. In the vortex chamber 34, the first fluid flow path 54 is in a first direction 56 around the vortex chamber 34, while the second fluid flow path 58 can be in a second direction 60 around the vortex chamber 34 in the opposite direction. The connections to the vortex chamber 34 are on opposite sides for symmetrical positions along the center line of the insert 30.

The step of flowing the fluid through the insert 30 can further include flowing the fluid between the vortex chamber 34 and the feedback chamber 36. FIGS. 2-4 show the first transition channel 46 and the second transition channel 48 for this step of flowing. The flowing between the vortex chamber 34 and the feedback chamber 36 corresponds to the step of alternating the flow path, so that the flow through the larger second transition channel 48 is different than the flow through the smaller first transition channel 46. This flow path is an asymmetric flow path 66 due to the first and second transition channels 46, 48. The connections to the vortex chamber 34 and the feedback chamber 36 are also tangent connections on opposite sides for symmetrical positions along the center line. However, the first and second transition channels 46, 48 are different so that the flow path remains asymmetric, despite the symmetry in the positions around the vortex chamber 34 and the feedback chamber 36.

Since the step of flowing between the vortex chamber 34 and the feedback chamber 36 corresponds to the step of alternating, the first fluid flow path 54 and the second fluid flow path 56 are similarly related in the feedback chamber 36. In the feedback chamber 36, the first fluid flow path 54 is in a first circulation direction 62 around the feedback chamber 36, while the second fluid flow path 58 can be in a second circulation direction 64 around the feedback chamber 36 in the opposite direction to the first circulation direction 62. The connections to the vortex chamber 34 and the feedback chamber 36 are on opposite sides for symmetrical positions along the center line of the insert 30 and tangent to both the vortex chamber 34 and the feedback chamber 36.

Alternate embodiments further include the step of flowing the fluid from the feedback chamber 36 to the inlet chamber 32. When the insert 30 has a first flowback channel 50 and a second flowback channel 52, the step of flowing includes recycling fluid from the feedback chamber 36 back to the inlet chamber 32 through the flowback channels, 50, 52 according to the step of alternating at the switch 44. Since the step of flowing between the feedback chamber 36 and the inlet chamber 32 corresponds to the step of alternating, the step of flowing of the method includes alternating between the first flowback channel 50 and the second flowback channel 52. The connections to the feedback chamber 36 are on opposite sides for symmetrical positions along the center line of the insert 30 and tangent to the feedback chamber 36. The method controls fluid flow by the variable resistance in the insert. The asymmetric flow path 66 relative to the feedback chamber 36 creates the pressure profile with a plurality of levels, such as a lower level 72, a middle level 74, and a higher level 76. Alternate embodiments may include more feedback chambers, larger or smaller feedback chambers, etc., which corresponds to more than three levels. There may also be other portions of the flow path 66 with asymmetry. The method can vary the strength of the pressure pulse and frequency of the pressure pulse to vibrate a tubular string for the required conditions in the wellbore. The present invention can be adjusted for stronger vibrations and lower frequency to pass a particularly severe bend in the rock formation or for weaker vibrations and higher frequency for different wellbore conditions.

The present invention can control fluid flow in a downhole tool for fluidic agitators and fluidic oscillators. The tool assembly of the present invention is typically used for a fluidic agitator to generate vibrations in a wellbore. The vibration of a tubular string, such as a drill string or casing string, allows the tubular string to pass through the rock formations in the wellbore more easily and with less risk of damage to the string. The tool assembly includes an insert with a feedback chamber in a particular relationship to an inlet chamber, switch, vortex chamber, and flowback channels.

In particular, the prior art required changing the area of the inlet to change the frequency of the pressure profile. The change of the area of the inlet resulted in a corresponding change to inlet flow speed and change to strength of the pressure pulse for the oscillation or vibration. There was no system to achieve the lower frequencies, while maintaining strength. Some tools have added multiple vortex chambers or circulation chambers between the input chamber and the vortex chamber to affect frequency and multiple level pressure profiles. However, the inlet and outlets must change on the housing, and there may not be sufficient space to include as many circulation chambers as needed. Other prior art relied on changing the length of the feedback and inlet channels. However, the change was not efficient, and there could only be small effects on frequency within the lengthening in the limited space on the insert. The present invention includes the feedback chamber as an additional feedback control. The size, number, and connection to the transition channels now determines frequency and strength of the pressure profile. The length of feedback channels, area of the inlet and the position of the inlet relative to the outlet no longer need to be modified in order to maintain control of frequency and strength. The feedback chamber of the present invention allows for compact arrangement of the inlet and outlet, without reducing the ability to regulate the greater range of frequencies and to maintain a sufficiently strong pressure pulse.

Embodiments further includes a particular asymmetry in the transitional channels between the feedback chamber and the vortex chamber. The asymmetry can be a result of different dimensions, such as width of the second transition channel being larger than the width of the first transition channel. In the present invention, the asymmetry does not rely on the type of connection being tangent or radial. The benefit in easier fabrication and durability of the insert with this type of asymmetry is an improvement and advantage over known fluidic agitators. The wear on different surfaces is not as unbalanced, so the working life and control of the present invention is a better flow control with more reliable and precise vibrations.

The foregoing disclosure and description of the invention is illustrative and explanatory thereof. Various changes in the details of the illustrated structures, construction and method can be made without departing from the true spirit of the invention.

We claim:

1. A tool assembly for installation in a wellbore, the tool assembly comprising:

a housing having an inlet and an outlet;

an insert mounted in said housing; and a cover fitted over said insert in said housing, said cover sealing said insert within said housing, wherein said insert comprises an inlet chamber, a vortex chamber, and a feedback chamber in fluid connection between said vortex chamber and said inlet chamber, said inlet chamber being in fluid connection with said vortex chamber directly and through said feedback chamber, wherein fluid flow through said insert has a pressure profile comprised of a plurality of levels determined by said feedback chamber, wherein said pressure profile has a frequency determined by said feedback chamber, when said inlet chamber maintains a constant position and fluid connection to said vortex chamber, wherein said inlet chamber, said vortex chamber, and said feedback chamber are in an asymmetric flow path, wherein said pressure profile has a lower level, middle level, and a higher level wherein said asymmetric flow path comprises:

a first fluid flow path from said inlet chamber to said first input channel and to said vortex chamber is in a first direction around said vortex chamber; and a second fluid flow path from said inlet chamber to said second input channel and to said vortex chamber is in a second direction around said vortex chamber, said second direction being opposite said first direction, wherein said first transition channel has a first width dimension, and wherein said second transition channel has a second width dimension larger than said first width dimension of said first transition channel.

2. The tool assembly, according to claim 1, said inlet chamber being in fluid connection with said inlet of said housing, said vortex chamber being in fluid connection with said inlet chamber and having an output in fluid connection to said outlet of said housing, wherein said insert comprises:

a first input channel connecting said inlet chamber to one side of said vortex chamber;

a second input channel connecting said inlet chamber to an opposite side of said vortex chamber;

a first transition channel connecting said vortex chamber to one side of said feedback chamber;

a second transition channel connecting said vortex chamber to an opposite side of said feedback chamber;

a first flowback channel extending from said feedback chamber to said inlet chamber; and a second flowback channel extending from said feedback chamber to said inlet chamber, and wherein said inlet chamber further comprises a switch means for a flow path alternating between said first input channel and said second input channel.

3. The tool assembly, according to claim 2, wherein said first input channel is tangent to said vortex chamber, said second input channel being tangent to said vortex chamber on said opposite side of said vortex chamber wherein said first fluid flow from said input chamber to said first input channel and to said vortex chamber and to said feedback chamber is in a first circulation direction around said feedback chamber, and wherein said second fluid flow from said input chamber to said second input channel and to said vortex chamber and to said feedback chamber is in a second circulation direction around said feedback chamber, said second circulation direction being opposite said first circulation direction.

4. The tool assembly, according to claim 2, wherein said first flowback channel is tangent to said feedback chamber, said second flowback channel being tangent to said feedback chamber on said opposite side of said feedback chamber.

5. The tool assembly, according to claim 1, wherein said first transition channel is tangent to said vortex chamber and tangent to said feedback chamber on one side of said feedback chamber, said second transition channel being tangent to said vortex chamber on said opposite side of said vortex chamber and tangent to said feedback chamber on an opposite side of said feedback chamber.

6. A method for fluid control in a wellbore, the method comprising the steps of:

assembling a tool comprised of a housing having an inlet and an outlet, an insert mounted in said housing, and a cover fitted over said insert in said housing, said cover sealing said insert within said housing, wherein said insert comprises an inlet chamber, a vortex chamber, and a feedback chamber in fluid connection between said vortex chamber and said inlet chamber, said inlet chamber being in fluid connection with said vortex chamber directly and through said feedback chamber, wherein fluid flow through said insert has a pressure profile comprised of a plurality of levels determined by said feedback chamber, and wherein said pressure profile has a frequency determined by said feedback chamber, when said inlet chamber maintains a constant position and fluid connection to said vortex chamber;

installing said tool in a string;

flowing a fluid through said insert; and generating vibrations in said tool according to the pressure profile, wherein said inlet chamber is in fluid connection with said inlet of said housing, wherein said vortex chamber is in fluid connection with said inlet chamber, said vortex chamber having an output in fluid connection to said outlet of said housing, wherein said insert further comprises:

a first input channel connecting said inlet chamber to one side of said vortex chamber; and a second input channel connecting said inlet chamber to an opposite side of said vortex chamber, and wherein said inlet chamber further comprises a switch, wherein the step of flowing is comprised of the step of:

alternating the flow path between said first input channel and said second input channel, wherein said first input channel is tangent to said vortex chamber, said second input channel being tangent to said vortex chamber on said opposite side of said vortex chamber, and wherein the step of flowing is further comprised of the steps of:

generating a first fluid flow from said input chamber to said first input channel and to said vortex chamber in a first direction around said vortex chamber;

switching the flow path between said first input channel and said second input channel; and generating a second fluid flow from said input chamber to said second input channel and to said vortex chamber in a second direction around said vortex chamber, said second direction being opposite said first direction.

7. The method for fluid control, according to claim 6, wherein said inlet chamber, said vortex chamber, and said feedback chamber are in an asymmetric flow path, and wherein said insert further comprises:

a first transition channel connecting said vortex chamber to one side of said feedback chamber; and a second transition channel connecting said vortex chamber to an opposite side of said feedback chamber, wherein the step of flowing is further comprised of the step of:

flowing said fluid between said vortex chamber and said feedback chamber, according to the step of alternating the flow path.

8. The method for fluid control, according to claim 7, wherein said first transition channel is tangent to said vortex chamber and tangent to said feedback chamber on one side of said feedback chamber, said second transition channel being tangent to said vortex chamber on said opposite side of said vortex chamber and tangent to said feedback chamber on an opposite side of said feedback chamber, wherein said first transition channel has a first width dimension, and wherein said second transition channel has a second width dimension larger than said first width dimension of said first transition channel.

9. The method for fluid control, according to claim 6, the method further comprising the step of:

generating said first fluid flow from said input chamber to said first input channel and to said vortex chamber and to said feedback chamber in a first circulation direction around said feedback chamber;

switching the flow path between said first input channel and said second input channel; and generating said second fluid flow from said input chamber to said second input channel and to said vortex chamber and to said feedback in a second circulation direction around said feedback chamber, said second circulation direction being opposite said first circulation direction.

10. The method for fluid control, according to claim 6, wherein said insert further comprises:

a first flowback channel extending from said feedback chamber to said input chamber; and a second flowback channel extending from said feedback chamber to said input chamber; and wherein the method further comprising the step of:

flowing said fluid from said feedback chamber and to said inlet chamber, according to the step of alternating the flow path.

11. The method for fluid control, according to claim 10, wherein said first flowback channel is tangent to said feedback chamber, said second flowback channel being tangent to said circulation chamber on said opposite side of said feedback chamber, the method further comprising the steps of:

generating said first fluid flow from said input chamber to said first input channel and to said vortex chamber and to said feedback chamber and back to said input chamber;

switching the flow path between said first input channel and said second input channel; and generating said second fluid flow from said input chamber to said second input channel and to said vortex chamber and to said feedback chamber and back to said input chamber.

12. A tool assembly for installation in a wellbore, the tool assembly comprising:

a housing having an inlet and an outlet;

an insert mounted in said housing; and a cover fitted over said insert in said housing, said cover sealing said insert within said housing, wherein said insert comprises an inlet chamber, a vortex chamber, and a feedback chamber in fluid connection between said vortex chamber and said inlet chamber, said inlet chamber being in fluid connection with said vortex chamber directly and through said feedback chamber, wherein said inlet chamber, said vortex chamber, and said feedback chamber are in an asymmetric flow path, said inlet chamber being in fluid connection with said inlet of said housing, said vortex chamber being in fluid connection with said inlet chamber and having an output in fluid connection to said outlet of said housing;

wherein said insert comprises:

a first input channel connecting said inlet chamber to one side of said vortex chamber;

a second input channel connecting said inlet chamber to an opposite side of said vortex chamber;

a first transition channel connecting said vortex chamber to one side of said feedback chamber;

a second transition channel connecting said vortex chamber to an opposite side of said feedback chamber;

a first flowback channel extending from said feedback chamber to said inlet chamber; and a second flowback channel extending from said feedback chamber to said inlet chamber, wherein said inlet chamber further comprises a switch means for the flow path alternating between said first input channel and said second input channel, wherein said asymmetric flow path comprises:

a first fluid flow path from said inlet chamber to said first input channel and to said vortex chamber is in a first direction around said vortex chamber; and a second fluid flow path from said inlet chamber to said second input channel and to said vortex chamber is in a second direction around said vortex chamber, said second direction being opposite said first direction.

13. The tool assembly, according to claim 12, wherein said first transition channel has a first width dimension, and wherein said second transition channel has a second width dimension larger than said first width dimension of said first transition channel.

14. The tool assembly, according to Claim to 13, wherein said first transition channel is tangent to said vortex chamber and tangent to said feedback chamber on one side of said feedback chamber, said second transition channel being tangent to said vortex chamber on said opposite side of said vortex chamber and tangent to said feedback chamber on an opposite side of said feedback chamber.

15. The tool assembly, according to claim 12, wherein said first flowback channel is tangent to said feedback chamber, said second flowback channel being tangent to said feedback chamber on said opposite side of said feedback chamber.

16. The tool assembly, according to claim 12, wherein fluid flow through said insert has a pressure profile comprised of a plurality of levels determined by said feedback chamber, and wherein said pressure profile has a frequency determined by said feedback chamber, when said inlet chamber maintains a constant position and fluid connection to said vortex chamber.

* * * * *